US007011216B2

(12) United States Patent
Magliocco et al.

(10) Patent No.: US 7,011,216 B2
(45) **Date of Patent: *Mar. 14, 2006**

(54) PROCESS FOR THE BENEFICIATION OF SULFIDE MINERALS

(75) Inventors: Lino G. Magliocco, Shelton, CT (US); Alan S. Rothenberg, Wilton, CT (US)

(73) Assignee: Cytec Technology Corp., Wilmington, DE (US)

( * ) Notice: Subject to any disclaimer, the term of this patent is extended or adjusted under 35 U.S.C. 154(b) by 4 days.

This patent is subject to a terminal disclaimer.

(21) Appl. No.: 10/940,171

(22) Filed: Sep. 14, 2004

(65) Prior Publication Data

US 2005/0042157 A1 Feb. 24, 2005

Related U.S. Application Data

(63) Continuation of application No. 10/270,754, filed on Oct. 15, 2002, now Pat. No. 6,820,746.

(51) Int. Cl.
*B03D 1/02* (2006.01)
*B03D 1/012* (2006.01)

(52) U.S. Cl. ..... 209/166

(58) Field of Classification Search ..... 209/166, 209/167; 252/61

See application file for complete search history.

(56) References Cited

U.S. PATENT DOCUMENTS

| | | | | |
|---|---|---|---|---|
| 4,584,097 | A | 4/1986 | Fu et al. | 209/166 |
| 6,732,867 | B1 * | 5/2004 | Magliocco et al. | 209/166 |
| 6,820,746 | B1 * | 11/2004 | Magliocco et al. | 209/166 |

* cited by examiner

*Primary Examiner*—Thomas M. Lithgow
(74) *Attorney, Agent, or Firm*—Fran S. Wasserman; Joseph J. Mallon

(57) ABSTRACT

Froth flotation processes, useful for beneficiating base metal mineral values from metal sulfide ore, utilize a collector comprising an N-butoxycarbonyl-O-alkylthionocarbamate selected from the group consisting of N-butoxycarbonyl-O-methylthionocarbamate, N-butoxycarbonyl-O-ethylthionocarbamate, N-butoxycarbonyl-O-propylthiononocarbamate, N-butoxycarbonyl-O-butylthionocarbamate, N-butoxycarbonyl-O-pentylthionocarbamate, and N-butoxycarbonyl-O-hexylthionocarbamate.

8 Claims, No Drawings

PROCESS FOR THE BENEFICIATION OF SULFIDE MINERALS

This application is a continuation of Ser. No. 10/270754 filed Oct. 15, 2002 now U.S. Pat. No. 6,820,746.

BACKGROUND OF THE INVENTION

1. Field of the Invention

This invention relates to froth flotation processes for the recovery of metal values from base metal sulfide ores. More particularly, it relates to processes that employ sulfide mineral collectors comprising certain N-butoxycarbonyl-O-alkylthionocarbamate compounds which exhibit excellent metallurgical performance over a broad range of pH values.

2. Description of the Related Art

Froth flotation is a widely used process for beneficiating ores containing valuable minerals. A typical froth flotation process involves intermixing an aqueous slurry containing finely ground ore particles with a frothing or foaming agent to produce a froth. Ore particles that contain the desired mineral are preferentially attracted to the froth because of an affinity between the froth and the exposed mineral on the surfaces of the ore particles. The resulting beneficiated minerals are then collected by separating them from the froth. Chemical reagents known as "collectors" are commonly added to the slurry to increase the selectivity and efficiency of the separation process, see U.S. Pat. No. 4,584,097, which is hereby incorporated herein by reference.

Froth flotation is especially useful for separating finely ground valuable minerals from their associated gangue or for separating valuable minerals from one another. Because of the large scale on which mining operations are typically conducted and the large difference in value between the desired mineral and the associated gangue, even relatively small increases in separation efficiency provide substantial gains in productivity.

SUMMARY OF THE INVENTION

Unexpectedly, it has now been found that N-butoxycarbonyl-O-alkylthionocarbamates selected from the group consisting of N-butoxycarbonyl-O-methylthionocarbamate, N-butoxycarbonyl-O-ethylthionocarbamate, N-butoxycarbonyl-O-propylthiononocarbamate, N-butoxycarbonyl-O-butylthionocarbamate, N-butoxycarbonyl-O-pentylthionocarbamate, and N-butoxycarbonyl-O-hexylthionocarbamate are particularly effective in froth flotation processes. A preferred embodiment provides a froth flotation process for beneficiating an ore, comprising: forming a slurry comprising water and particles of an ore, the ore containing sulfide minerals; intermixing the slurry with effective amounts of a frothing agent and a collector to form a froth containing beneficiated sulfide minerals; and collecting the beneficiated sulfide minerals; the collector comprising an N-butoxycarbonyl-O-alkylthionocarbamate selected from the group consisting of N-butoxycarbonyl-O-methylthionocarbamate, N-butoxycarbonyl-O-ethylthionocarbamate, N-butoxycarbonyl-O-propylthiononocarbamate, N-butoxycarbonyl-O-butylthionocarbamate, N-butoxycarbonyl-O-pentylthionocarbamate, and N-butoxycarbonyl-O-hexylthionocarbamate.

These and other embodiments are described in greater detail below.

DETAILED DESCRIPTION OF THE PREFERRED EMBODIMENTS

In preferred embodiments, sulfide metal and mineral values are recovered by froth flotation methods in the presence of a collector, the collector comprising at least one N-butoxycarbonyl-O-alkylthionocarbamate selected from the group consisting of N-butoxycarbonyl-O-methylthionocarbamate, N-butoxycarbonyl-O-ethylthionocarbamate, N-butoxycarbonyl-O-propylthiononocarbamate, N-butoxycarbonyl-O-butylthionocarbamate, N-butoxycarbonyl-O-pentylthionocarbamate, and N-butoxycarbonyl-O-hexylthionocarbamate. The term "N-butoxycarbonyl-O-alkylthionocarbamate" is used herein to refer to the compounds in the aforementioned group, including isomers thereof. For example, N-iso-butoxycarbonyl-O-isobutylthionocarbamate is an example of a preferred N-butoxycarbonyl-O-butylthionocarbamate. Other examples of preferred N-butoxycarbonyl-O-alkyl-thionocarbamates include N-isobutoxycarbonyl-O-ethylthionocarbamate, N-isobutoxy-carbonyl-O-hexylthionocarbamate, and N-butoxycarbonyl-O-isobutylthionocarbamate. Preferably, N-butoxycarbonyl-O-alkylthionocarbamates are employed as sulfide collectors in a froth flotation process that provides enhanced beneficiation of sulfide mineral values from base metal sulfide ores over a wide range of pH values and more preferably under, neutral, slightly alkaline and highly alkaline conditions.

N-butoxycarbonyl-O-alkylthionocarbamates may be produced in various ways. For example, butyl chloroformate may be reacted with a thiocyanate salt, e.g., sodium thiocyanate, to form a butoxycarbonyl isothiocyanate intermediate. Thiocyanate salts and butyl chloroformate may be obtained from commercial sources; butyl chloroformate may also be synthesized by reacting phosgene with butanol. The butoxycarbonyl isothiocyanate intermediate may be reacted with an alcohol ROH to form the desired N-butoxycarbonyl-O-alkylthionocarbamate. The R group in ROH represents an alkyl group having from one to six carbon atoms. Examples of ROH include methanol, ethanol, propanol, isopropanol, n-butanol, isobutanol, n-pentanol, isopentanol, n-hexanol and isohexanol.

Those skilled in the art understand that the terms "beneficiate", "beneficiation", and "beneficiated" refer to an ore enrichment process in which the concentration of the desired mineral and/or metal in the ore increases as the process proceeds. For example, a preferred froth flotation process comprises forming a slurry comprising water and particles of an ore, intermixing the slurry with a frothing agent and a collector to form a froth containing beneficiated minerals, and collecting the beneficiated minerals.

The ore particles in the slurry are preferably made by size-reducing the ore to provide ore particles of flotation size, in a manner generally known to those skilled in the art. The particle size to which a particular ore is size-reduced in order to liberate mineral values from associated gangue or non-values, i.e., liberation size, typically varies from ore to ore and may depend on a number of factors, e.g., the geometry of the mineral deposits within the ore, e.g., striations, agglomeration, comatrices, etc. A determination that particles have been size-reduced to liberation size may be made by microscopic examination using methods known to those skilled in the art. Generally, and without limitation, suitable particle sizes vary from about 50 mesh to about 400 mesh. Preferably, the ore is size-reduced to provide flotation sized particles in the range of about +65 mesh to about −200 mesh. Especially preferably for use in the present method are base metal sulfide ores which have been size-reduced to provide from about 14% to about 30% by weight of particles of +100 mesh and from about 45% to about 75% by weight of particles of −200 mesh sizes. Size reduction of the ore may be performed in accordance with any method known to those skilled in this art. For example, the ore can be crushed to −10 mesh size followed by wet grinding in a steel ball mill to the desired mesh size, or pebble milling may be used.

The slurry (also known as a pulp or pulp slurry) may be formed in various ways known to those skilled in the art, e.g., by intermixing liberation-sized ore particles with water, by grinding the ore in the presence of water, etc. The pH of the slurry may be adjusted at any stage, e.g., by adding a pH modifier (acid or base) to the slurry or to the grind during size reduction, to provide the slurry with any desired pH. Preferred pH modifiers include sulfuric acid and lime. Thus, for example, good beneficiation may be obtained at pulp slurry pH values in the range of about 7 to about 12, and particularly in the pH range of from about 9 to about 11.5. The pH of the slurry may be adjusted at any point in the process of preparing the ore for froth flotation or in the froth flotation process itself. The aqueous slurry of ore particles preferably contains from about 10% to about 60% pulp solids, more preferably about 25% to about 50% pulp solids, most preferably from about 30% to about 40% pulp solids, by weight based on total slurry weight.

In accordance with a preferred embodiment, the flotation of copper, zinc and lead sulfides is performed at a pH in the range of about 6 to about 12, more preferably about 9 to about 11.5. It has been discovered that the N-butoxycarbonyl-O-alkylthionocarbamate collectors provide exceptionally good collector strength, together with excellent collector selectivity, even at reduced collector dosages, when froth flotation is conducted in the aforementioned pH range.

The slurry is preferably conditioned by intermixing it with effective amounts of a frothing agent and a collector comprising at least one N-butoxycarbonyl-O-alkylthionocarbamate to form a froth containing beneficiated sulfide minerals. The frothing agent, collector and slurry may be intermixed in any order. For example, the collector may be added to the slurry and/or to the grind in accordance with conventional methods. By "effective amount" is meant any amount of the respective components which provides a desired level of beneficiation of the desired metal values.

Any frothing agent known to those skilled in the art may be employed in the froth flotation process. Non-limiting examples of suitable frothing agents include: straight or branched chain low molecular weight hydrocarbon alcohols, such as $C_6$ to $C_8$ alkanols, 2-ethyl hexanol and 4-methyl-2-pentanol (also known as methyl isobutyl carbinol or MIBC), as well as pine oils, cresylic acid, glycols, and polyglycols. Mixtures of frothing agents may be used. Effective amounts of frothing agents for a particular froth flotation process may be determined by routine experimentation. Typical amounts of frothing agent are often in the range of from about 0.01 to about 0.2 pound of frothing agent per ton of ore treated, although higher or lower amounts of frothing agent may be effective in particular situations.

The N-butoxycarbonyl-O-alkylthionocarbamate collector may be used alone, in combination with one another, and/or in combination with other sulfide mineral collectors such as xanthates, xanthogen formates, thiophosphates, thioureas, and/or thionocarbamates, e.g., dialkylthionocarbamates. A collector comprising an N-butoxycarbonyl-O-alkylthionocarbamate is preferably intermixed with the frothing agent and pulp slurry in amounts ranging from about 0.005 to about 5 pounds of collector per ton of ore in the slurry, more preferably about 0.1 lb. to about 2 lbs./ton, same basis. In froth flotation processes in which it is desirable to selectively collect copper sulfide minerals and selectively reject iron sulfide minerals such as pyrite and pyrrhotite, as well as other gangue sulfides, the collector is preferably used in amounts of from about 0.01 lb./ton to about 5 lbs./ton of ore in the slurry. In bulk sulfide froth flotation processes, higher levels of collector are often preferred. Effective amounts of collector for a particular froth flotation process may be determined by routine experimentation.

The intermixing of the slurry with an effective amount of a frothing agent and an effective amount of a N-butoxycarbonyl-O-alkylthionocarbamate is preferably conducted in a manner that produces a froth containing beneficiated sulfide minerals. Formation of the froth may be facilitated by utilizing suitably vigorous mixing conditions and/or injecting air into the slurry. Routine experimentation in accordance with conventional froth flotation methods may be utilized to determine suitable conditions to float the desired sulfide mineral values in the froth concentrate and, preferably, selectively reject or depress pyrite and other gangue sulfides.

The N-butoxycarbonyl-O-alkylthionocarbamates, although virtually water-insoluble, have the distinct advantage of being easily dispersible. For example, when added to a flotation cell, these collectors provide higher copper recovery in the first flotation stage together with improved copper recovery overall, indicating improved kinetics of flotation, as shown in the examples provided below.

The N-butoxycarbonyl-O-alkylthionocarbamate collectors may be used to selectively concentrate or collect certain metal value sulfides, particularly those of copper, lead and zinc from other gangue sulfides, e.g., pyrite and pyrrhotite, and other gangue materials, e.g., silicates, carbonates, etc. These collectors may also be used in situations in which it is desirable to collect all of the sulfides in an ore, including sphalerite (ZnS) and the iron sulfides, i.e., pyrite and pyrrhotite, in addition to the copper sulfide minerals.

It will be appreciated by those skilled in the art that various omissions, additions and modifications may be made to the processes described above without departing from the scope of the invention, and all such modifications and changes are intended to fall within the scope of the invention, as defined by the appended claims.

EXAMPLES 1–6

A copper ore from South America is used in the following flotation tests. This ore contains about 1.2% copper, 4% iron and 278 ppm molybdenum. This ore also contains the usual silicate or siliceous type gangue.

The ore is ground to 75% passing a 100 Tyler mesh (150 μm) screen using a mild steel rod mill containing 7.5 kg of mild steel rods. The grind solids are 66% in water. Lime is added to the rod mill in a sufficient amount so as to provide a flotation pH of 11, similar to that used in the concentrator. Diesel fuel (10 grams per ton of ore in the pulp) is also added to the mill to promote Mo flotation. The ore pulp is then discharged into a flotation cell and the pulp volume adjusted to 30–34% solids for flotation.

A Denver D-12 flotation machine set at 1000 rpm is used for the flotation tests. The pulp is agitated to ensure homogeneity. A collector as shown in Table 1 and frother are then added to the pulp and allowed to condition for 2 minutes. The frother used is a blended product containing AEROFROTH® 76A Frother, available commercially from Cytec Industries, Inc., West Paterson, N.J. The dosage of the frother is 15 grams per ton of ore in the pulp (g/t) for all of the tests.

Flotation concentrates are collected at 1, 3 and 6 minute intervals. The concentrates and tails are filtered, dried and assayed for Cu, Fe and Mo. The results shown in Table 1 clearly show the superiority of the N-butoxycarbonyl-O-alkylthionocarbamate collectors over prior collectors, which either yield low recovery or poor selectivity against iron (high Fe recovery). Because of the large scale on which mining operations are typically conducted and the large difference in value between the desired mineral and the associated gangue, these increases in separation efficiency provide substantial gains in productivity.

TABLE 1

| No. | Collector | Dose. g/t | % Cu Rec. | % Cu Grade | % Fe Rec. | % Mo Rec. |
|---|---|---|---|---|---|---|
| 1 C | N-Ethoxycarbonyl-O-isobutylthionocarbamate | 10 | 88.6 | 8.7 | 26.7 | 75.8 |
| 2 | N-Isobutoxycarbonyl-O-isobutylthionocarbamate | 10 | 89.2 | 8.0 | 28.2 | — |
| 3 | N-Isobutoxycarbonyl-O-ethylthionocarbamate | 10 | 88.8 | 9.6 | 27.3 | — |
| 4 | N-Isobutoxycarbonyl-O-hexylthionocarbamate | 10 | 90.1 | 9.9 | 24.5 | 76.6 |

EXAMPLES 5–10

A copper/molybdenum ore from South America is used in the following flotation tests. This ore contains about 1.4% copper, 5.8% iron and 113 ppm molybdenum. This ore also contains the usual silicate or siliceous type gangue.

The ore is ground to 80% passing a 65 Tyler mesh (212 μm) screen using a mild steel rod mill containing 7.5 kg of mild steel rods. The grind solids are 66% in water. Lime is added to the rod mill in a sufficient amount so as to provide a flotation pH of 10–10.5, similar to that used in the concentrator. A collector at the dosage shown in Table 2 and a frother (9 g/t) are added to the mill along with diesel fuel (6 g/t to promote Mo flotation). The frother used is AEROFROTH® 70 Frother, a methyl isobutyl carbinol product available commercially from Cytec Industries, Inc., West Paterson, N.J. The ore pulp is then discharged into a flotation cell and the pulp volume adjusted to 30–34% solids for flotation.

A Denver D-12 flotation machine set at 1000 rpm is used for these flotation tests. The pulp is agitated to ensure homogeneity. Additional frother (8 g/t) is then added to the pulp and allowed to condition for 2 minutes. Flotation concentrates are collected at 1, 3 and 6 minute intervals. The concentrates and tails are filtered, dried and assayed for Cu, Fe and Mo. The results shown in Table 2 clearly show the superiority of the N-butoxycarbonyl-O-alkylthionocarbamate collectors, which produce higher recoveries of copper and molybdenum minerals as compared to prior collectors. Because of the large scale on which mining operations are typically conducted and the large difference in value between the desired mineral and the associated gangue, these increases in separation efficiency provide substantial gains in productivity.

TABLE 2

| No. | Collector | Dose. g/t | % Cu Rec. | % Cu Grade | % Fe Rec. | % Mo Rec. |
|---|---|---|---|---|---|---|
| 5C | N-Ethoxycarbonyl-O-isobutylthionocarbamate | 10 | 68.5 | 12.0 | 16.4 | 40.0 |
| 6C | N-Methoxycarbonyl-O-isobutylthionocarbamate | 10 | 68.2 | 12.5 | 16.9 | 39.4 |
| 7 | N-Butoxycarbonyl-O-isobutylthionocarbamate | 10 | 72.6 | 14.3 | 18.9 | 48.1 |

TABLE 2-continued

| No. | Collector | Dose. g/t | % Cu Rec. | % Cu Grade | % Fe Rec. | % Mo Rec. |
|---|---|---|---|---|---|---|
| 8 | N-Isobutoxycarbonyl-O-ethyl thionocarbamate | 10 | 72.4 | 13.7 | 19.6 | 50.4 |
| 9 | N-Isobutoxycarbonyl-O-isobutylthionocarbamate | 10 | 73.1 | 12.1 | 20.1 | 50.2 |
| 10 | N-Isobutoxycarbonyl-O-hexylthionocarbamate | 10 | 74.1 | 13.9 | 18.4 | 62.3 |

EXAMPLE 11

Synthesis of isobutoxycarbonyl isothiocyanate: 136.58 grams (1 mole) of 99% isobutyl chloroformate are added to a 50% thiocyanate solution containing 81 grams (1 mole) of NaSCN, 81 grams of water, 4.36 grams of quinoline (catalyst) and 1.8 grams of $Na_2CO_3$ (base) while maintaining a reaction temperature of 25–30° C. with agitation. The reaction is monitored for the consumption of the chloroformate during the formation of an upper layer of isobutoxycarbonyl isothiocyanate (approximately 4 hours). The contents of the reaction vessel are filtered to remove solid sodium chloride and the isobutoxycarbonyl isothiocyanate is isolated in the form of a layer that separates from the aqueous layer.

EXAMPLE 12

Synthesis of N-isobutoxycarbonyl-O-isobutylthionocarbamate: A procedure begun as described in Example 11 is continued by returning the isolated isobutoxycarbonyl isothiocyanate layer to the reaction vessel and adding 1.3 moles of isobutyl alcohol. The reaction temperature is maintained at about 20–25° C. for about 4 hours. The resulting thionocarbamate/isobutyl alcohol mixture is vacuum stripped at 23–25 inches Hg and 50° C. to remove water and some of the excess alcohol, followed by filtration to remove precipitated salt. About 215 grams of the final product is obtained in the form of a mixture of about 190 grams of N-isobutoxycarbonyl-O-isobutylthionocarbamate and about 25 grams isobutyl alcohol.

EXAMPLE 13

Synthesis of N-isobutoxycarbonyl-O-hexylthionocarbamate: A procedure begun as described in Example 11 is continued by returning the isolated isobutoxycarbonyl isothiocyanate layer to the reaction vessel and adding 1.3 moles of hexyl alcohol. The reaction temperature is maintained at about 20–25° C. for about 4 hours. The resulting thionocarbamate/hexyl alcohol mixture is vacuum stripped at 23–25 inches Hg and 50° C. to remove water and some of the excess alcohol, followed by filtration to remove precipitated salt. About 215 grams of the final product is obtained in the form of a mixture of about 190 grams of N-isobutoxycarbonyl-O-hexylthionocarbamate and about 25 grams hexyl alcohol.

What is claimed is:

1. A froth flotation process for beneficiating an ore, comprising:

forming a slurry comprising water and particles of an ore, the ore containing sulfide minerals;

intermixing said slurry with effective amounts of a frothing agent and a collector to form a froth containing beneficiated sulfide minerals; and collecting said beneficiated sulfide minerals;

the collector comprising an N-butoxycarbonyl-O-alkylthionocarbamate selected from the group consisting of N-butoxycarbonyl-O-methylthionocarbamate, N-butoxycarbonyl-O-ethylthionocarbamate, N-butoxycarbonyl-O-propylthionono-carbamate, N-butoxycarbonyl-O-pentylthionocarbamate, and N-butoxycarbonyl-O-hexylthionocarbamate.

2. The process of claim 1 in which said collector is intermixed with said slurry in an amount in the range of about 0.005 to about 5 lbs per ton of ore in said slurry.

3. The process of claim 1 in which said collector is intermixed with said slurry in an amount in the range of about 0.1 to about 2 lbs per ton of ore in said slurry.

4. The process of claim 1 in which said slurry has a pH in the range of about 6 to about 12.

5. The process of claim 1 in which said slurry has a pH in the range of about 9 to about 11.5.

6. The process of claim 1 in which said N-butoxycarbonyl-O-alkylthionocarbamate is N-butoxycarbonyl-O-ethylthionocarbamate.

7. The process of claim 1 in which said N-butoxycarbonyl-O-alkylthionocarbamate is N-butoxycarbonyl-O-hexylthionocarbamate.

8. The process of claim 1 in which said ore comprises a metal selected from the group consisting of copper, lead and zinc.

* * * * *